United States Patent [19]

Hershcovitch

[11] Patent Number: 4,654,183

[45] Date of Patent: Mar. 31, 1987

[54] PRODUCTION OF INTENSE NEGATIVE HYDROGEN BEAMS WITH POLARIZED NUCLEI BY SELECTIVE NEUTRALIZATION OF NEGATIVE IONS

[75] Inventor: Ady Hershcovitch, Mount Sinai, N.Y.

[73] Assignee: The United States of America as represented by the United States Department of Energy, Washington, D.C.

[21] Appl. No.: 579,747

[22] Filed: Feb. 13, 1984

[51] Int. Cl.[4] ..... G21G 4/04

[52] U.S. Cl. ..... 376/130; 376/915; 250/423 P

[58] Field of Search ..... 250/423 R, 423 P; 376/127, 129, 130, 915; 324/300, 313, 319

[56] References Cited

U.S. PATENT DOCUMENTS

| | | | |
|---|---|---|---|
| 3,959,649 | 5/1976 | Forsen | 250/299 |
| 4,020,350 | 4/1977 | Ducas | 250/423 P |
| 4,067,702 | 1/1978 | Hickman | 376/130 X |
| 4,140,576 | 2/1979 | Fink et al. | 376/127 X |
| 4,140,577 | 2/1979 | Fink et al. | 176/1 |
| 4,298,798 | 11/1981 | Huffman | 376/129 X |
| 4,336,230 | 6/1982 | Bethe et al. | 250/423 P X |
| 4,377,773 | 3/1983 | Hershcovitch et al. | 250/423 R X |
| 4,390,494 | 6/1983 | Salisbury | 324/319 X |
| 4,421,713 | 12/1983 | Manheimer et al. | 376/127 X |
| 4,486,665 | 12/1984 | Leung et al. | 376/129 X |

OTHER PUBLICATIONS

Bhaskar et al., *Photoproduction of Spin Polarized Hydrogen Atoms—Gas,* Am. Phys. Soc. 46, (21), 1387, 1981.

Kulsrud et al., *Fusion Reactor Plasmas in Polarized Nuclei–II,* 9th Int. Conf. on Plasma Physics+Cont. Nuc. Fus. Res., Balt., Md., Sep. 1–8, 1982.

Kleppner et al., Spin–Polarized Hydrogen, A.I.P. Conf. Proc., 95 (High Energy Spin Physics–1982).

Herschcovitch, *Generation of Intense Nuclear Polarized H–Beams by Selective Neutralization,* Brookhaven Nat'l Lab., Tech. Note Na 70, 2/28/83.

Blumberg et al., *Theory of the Photodetachment of Negative Ions in a Magnetic Field,* Physical Review, vol. 19, No. 2, 1/15/79.

*Photoproduct of Spin–Polarized Hydrogen Atoms, etc.,* Bhaskar et al., Physical Review Letters, Am. Phys. Soc., vol. 46, #12, 5/25/81, pp. 1387–1390.

Ambartzumian et al., *Selective Two–Step (STS) Photoionization of Atoms, etc.,* Applied Optics, vol. 11, #2, Feb. 1972, pp. 354–358.

*Primary Examiner*—Peter A. Nelson

*Attorney, Agent, or Firm*—Vale P. Myles; Michael J. Higgins; Judson R. Hightower

[57] ABSTRACT

A process for selectively neutralizing $H^-$ ions in a magnetic field to produce an intense negative hydrogen ion beam with spin polarized protons. Characteristic features of the process include providing a multi-ampere beam of $H^-$ ions that are intersected by a beam of laser light. Photodetachment is effected in a uniform magnetic field that is provided around the beam of $H^-$ ions to spin polarize the $H^-$ ions and produce first and second populations or groups of ions, having their respective proton spin aligned either with the magnetic field or opposite to it. The intersecting beam of laser light is directed to selectively neutralize a majority of the ions in only one population, or given spin polarized group of $H^-$ ions, without neutralizing the ions in the other group thereby forming a population of $H^-$ ions each of which has its proton spin down, and a second group or population of $H^o$ atoms having proton spin up. Finally, the two groups of ions are separated from each other by magnetically bending the group of $H^-$ ions away from the group of neutralized ions, thereby to form an intense $H^-$ ion beam that is directed toward a predetermined objective.

11 Claims, 5 Drawing Figures

PRODUCTION OF INTENSE NEGATIVE HYDROGEN BEAMS WITH POLARIZED NUCLEI BY SELECTIVE NEUTRALIZATION OF NEGATIVE IONS

The U.S. Government has rights in this invention pursuant to Contract Number DE-AC02-76CH00016, between the U.S. Department of Energy and Associated Universities Inc.

BACKGROUND OF THE INVENTION

The invention relates to processes for photo detaching negative ions in a magnetic field and, more particularly, relates to a process for achieving selective neutralization of a given population of negative hydrogen ions in a magnetic field in order to produce an intense negative hydrogen ion beam with spin polarized protons.

There has been an increasing demand in the last several years for spin polarized protons that are useful in a number of different applications for high energy research. The development of fusion reactors may also create the need for intense "high" energy neutral deuterium beams that have polarized nuclei. A number of different processes presently exist for producing such spin polarized protons and high energy neutral deuterium beams; however, all such present prior art methods known to the applicant are initiated by either polarizing an electron of the hydrogen atom, or by producing nuclear and electron spin polarized atomic gas. In such prior art processes, a necessary subsequent step is to either polarize the nuclear spin in one case, or to eject a particular spin state from a gas in an alternative case. Finally, the nuclear polarized atomic beam thus produced needs to be converted to either a positive or negative ion beam before it is entered into a suitable accelerator. All of these known prior art methods have certain major drawbacks. One such drawback is that considerable difficulty is encountered in attempting to produce a proper polarized atomic beam which has both high density and high velocity, as is necessary in order to avoid space charge effects and collisional destruction. A further significant disadvantage of such prior art methods is that the efficiency of converting polarized H to polarized $H^-$, or even to $H^+$, is rather poor in currently available processes.

One known process for achieving neutralization of accelerated ions by photo-induced charge detachment involves the employment of a laser beam that is directed across the path of a negative ion beam to effect photodetachment of electrons from the beam of ions. An example of that type of prior art process is disclosed in U.S. Pat. No. 4,140,577, which issued Feb. 20, 1979. A related U.S. Pat. No. 4,140,576, which also issued Feb. 20, 1979, discloses a cavity that is useful with a relatively efficient strip diode laser that emits monochromatically at an approximate wavelength equal to 8,000 Å for $H^-$ ions, in order to strip excess electrons by photodetachment with increased efficiency and reduced illumination required to obtain approximately 85 percent neutralization. Such prior art processes do not use selective neutralization of $H^-$ ions in a magnetic field as is done in the process of the invention as disclosed in the present application. Accordingly, no polarized ions or even neutrals result from such prior art processes.

Other types of processes are known in the prior art wherein isotope separation is achieved by selectively ionizing given isotopes with polarized laser light. For example, U.S. Pat. No. 3,959,649, which issued May 25, 1976, and U.S. Pat. No. 4,020,350, which issued Apr. 26, 1977, disclose methods in which polarized laser light is used in laser isotope separation processes that are employed to selectively ionize given isotopes. Although such prior art methods employ polarized laser light, they do not result in the production of any spin polarized nuclei. Accordingly, except insofar as such prior art processes provide an awareness and understanding of the uses of polarized laser light, they appear to be of minimal relevance with respect to the process of the present invention disclosed herein.

A somewhat more relevant prior art photodetachment method is described by W. A. M. Blumberg, W. M. Atano and D. J. Larson in an article entitled "Theory of the Photodetachment of Negative Ions in a Magnetic Field", which appeared at pp. 139–148 of Vol. 19, (No. 2) of the Jan. 15, 1979 issue of *Physical Review.* That paper presents a theory of a process for achieving photodetachment of atomic negative sulfer ions in a magnetic field. A basic element of the theory considered in that paper involves the confinement of the motion of the detached electron in the directions transverse to an applied magnetic field. Such confinement leads to the quantization of the transverse kinetic energy into the familar cyclotron, or Landau levels. As a result of the theoretical and experimental work reported by those authors, the theory discussed in the paper was said to predict the dependence of the photodetachment cross section upon magnetic field strength and upon light frequency. The experiments to confirm the theories discussed, were performed on ions that were confined in a trap of the Penning type, in which a uniform magnetic field and a quadrupolar static electric potential are present. The authors concluded that their theory, which was developed for $S^-$ atomic photodetachment, should also be equally valid for photodetachment of $O^-$.

In light of the shortcomings and disadvantages of all known prior art methods, as explained above, it remains desirable to provide a simple, essentially one-step photodetachment process that is operable to produce a multi-ampere beam of $H^-$ ions and to achieve laser neutralization of the $H^-$ ion beam with essentially 100 percent efficiency.

OBJECTS OF THE INVENTION

Accordingly, it is a primary object of the invention to provide a process for economically and efficiently producing a multi-ampere $H^-$ ion beam of either pulsed or steady state.

Another object of the invention is to provide a process for selective neutralization of $H^-$ beams in a magnetic field thereby to produce an intense negative hydrogen ion beam with spin polarized protons, while avoiding the disadvantages of prior art methods.

A further object of the invention is to provide a process that utilizes a beam of laser light in the range of 1135 Å to 32,000 Å to selectivly neutralize a majority of $H^-$ ions in a spin polarized beam of such ions, thereby to produce photodetachment products comprising free electrons and $H^o$ atoms.

Further objects and advantages of the invention will become apparent from the description of it that follows considered in conjunction with the accompanying drawings.

SUMMARY OF THE INVENTION

In one preferred arrangement of the invention, a multi-ampere beam of $H^-$ ions is passed through a uniform solenoid magnetic field that spin polarizes the $H^-$ ions to separate them into first and second groups, or populations, of ions, which groups have their respective protons either spin aligned with, or spin aligned in opposition to, the magnetic field. A beam of laser light is directed through the spin polarized beam of $H^-$ ions to selectively neutralize a majority (preferably substantially 100 percent) of the ions in one of the polarized groups or populations; consequently, that group can be readily separated from the intense beam of $H^-$ ions in the other group of spin polarized ions, by subjecting the $H^-$ ions to magnetic curvature.

DESCRIPTION OF THE PREFERRED EMBODIMENTS

At the outset, it should be understood that the novel process of the invention involves the principle that $H^-$ ions can be produced with spin polarized protons. Utilizing selective laser neutralization of only one proton spin state of such a multi-ampere $H^-$ ion beam, while the beam is subjected to a magnetic field, results in an $H^-$ ion beam and an atomic hydrogen beam that has polarized protons. Those two beam states are then easily separated from one another by bending the $H^-$ ions with a curved magnetic field, as will be more full described below. Such an essentially one-step process has the obvious advantage that multi-ampere $H^-$ ion beams can be produced having either pulse or steady state. Furthermore, commercially available lasers can be used in the process to achieve essentially 100 percent efficiency in the neutralization of the $H^-$ beam.

It should be understood that negative deuterium, $D^-$, ions can be produced with spin polarized protons, using the principles of the invention, as they are disclosed herein with particular reference to $H^-$ ions. Accordingly, for fusion application requiring $D^-$ ions, the present invention is of particular value.

Figure 1:
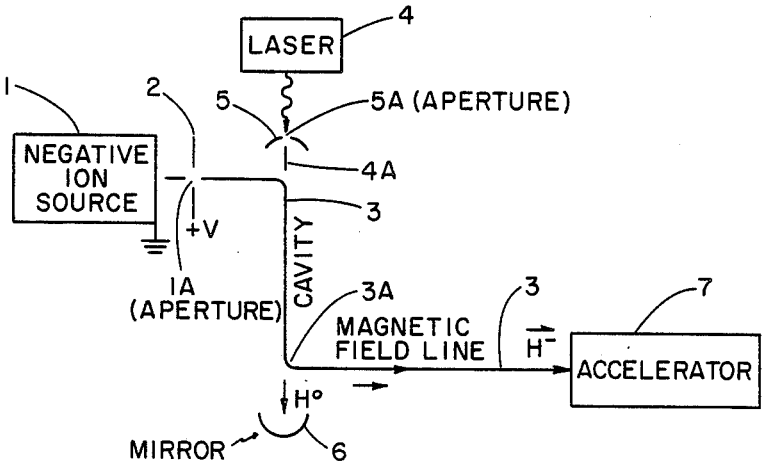
FIG. 1 is a schematic illustration of suitable apparatus, and its arrangement, for implementing a process for selective neutralization of $H^-$ ions in a magnetic field to produce an intense negative ion beam with spin polarized protons, according to one arrangement of the process of the subject invention.
Figure 2:
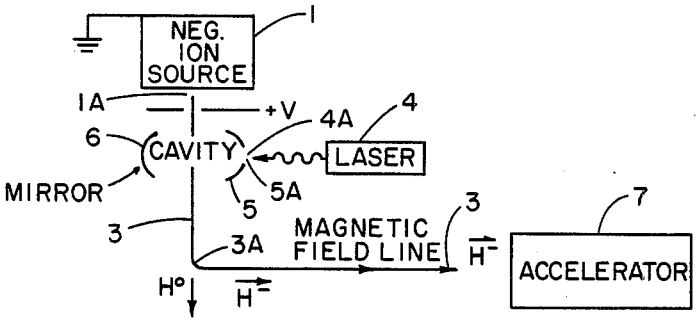
FIG. 2 is a schematic illustration of suitable operating components and their respective arrangement for implementing a process similar to that illustrated in FIG. 1, except that the laser cavity shown in FIG. 2 is positioned to intersect the ion beam at an angle transverse thereto, whereas the laser beam shown in FIG. 1 is co-linear with the ion beam at its point of intersection therewith.

FIGS. 1 and 2 illustrate alternative arrangements of various commercially available components that are used in practicing the preferred process of the invention. Considering first the arrangement shown in FIG. 1, it will be seen that a suitable negative ion source 1 is arranged to produce a multi-ampere beam of $H^-$ ions through an adjacent trimmer and focusing means 2. The ion beam is then introduced into a magnetic field, which is arranged in conventional manner to define a suitable magnetic field line 3, that is shown schematically by the curved arrows in FIG. 1. A commercial available laser 4, which will be more fully described below, is positioned to direct a beam of laser light 4A through an apperture 5A in convex mirror 5 and against the convex mirror 6. The beam of laser light 4A is oriented co-linear with the vertical section of the magnetic field line 3 to define a reflecting cavity, as shown in FIG. 1. As will be more fully discussed below, the magnetic field line 3 is bent in the area 3A, so that the magnetic field is effective to bend $H^-$ ions in an intense ion beam away from the $H^o$ atoms that are shown by the depicited arrow in FIG. 1 as being directed in a beam that maintains its alignment with the vertical portion of the magnetic field line 3. A suitable conventional particle accelerator 7 is positioned to receive the $H^-$ beam and to focus and accelerate it for any desired high energy research experimentation purpose.

The arrangement of components used in practicing the process of the invention shown in FIG. 2 is quite similar to that illustrated in FIG. 1, thus the same callout numbers will be used in FIG. 2, for designating essentially identical component parts. There is shown in FIG. 2 a suitably grounded negative ion source 1 that directs a multi-ampere beam 1A of $H^-$ ions through a focusing and trimming device 2 into a magnetic field line designated by the arrowed line 3. In this arrangement of the process of the invention, a laser 4 is positioned to direct a beam of laser light 4A in a direction that causes it to intersect the beam of each $H^-$ ions at an angle transverse thereto. Thus, the convex mirrors 5 and 6 are positioned to define a cavity that has its longitudinal axis essentially perpendicular to the vertical section of the magnetic field line 3. Otherwise, the process implemented with the component parts shown in FIG. 2 is arranged to operate in essentially the same manner as that shown in FIG. 1. Accordingly, $H^-$ ions are bent by the curved section 3A of the magnetic field line 3, thereby to direct the spin polarized $H^-$ ions in an intense beam toward the accelerator 7, as explained above with reference to FIG. 1.

From the foregoing description of the process of the invention it should be apparent that a variety of suitable conventional components can be used for the negative ion source 1, the focusing and trimming means 2, the means for defining the magnetic field line 3, the laser 4 and associated laser cavity mirrors 5 and 6, as well as for the accelerator 7, as discussed above. However, particular examples of the types of lasers that are most useful in practicing the invention will be set forth more fully below.

The magnetic field line 3 used in either arrangement shown in FIGS. 1 and 2, in practicing the preferred process of the invention, is formed as a uniform solenoidal magnetic field by use of any well known conventional array of suitable permanent or electro-magnets. When $H^-$ ions are provided in the multi-ampere beam of $H^-$ ions 1A that enters the magnetic field line 3 and is subjected to the uniform solenoidal magnetic field therein, one of the electrons in each $H^-$ ion will have its spin aligned in the direction of the magnetic field, while the other electron in each $H^-$ ion will have its spin aligned in the opposite direction. The proton spin in each of the $H^-$ ions will also be aligned either with, or opposite to, the magnetic field. For magnetic fields below $10^8$ Gauss, the $H^-$ ions have only one bound state, accordingly, there will be two populations of $H^-$ ions between which the sole difference is the orientation of their respective proton spins. The principle applied in practicing the method of the invention is to selectively neutralize only one population, or given spin polarized group, of $H^-$ ions, thereby forming a population of $H^-$ ions each of which has its proton spin down, and a second group or population of $H^o$ atoms having proton spin up.

After such selective neutralization of the two groups of ions is achieved, the negative ions in one group are readily separated from the neutral ions in the other group by passing the polarized ion beam through the curvature of an appropriately arranged magnetic field, such as through the bent portion 3A of the magnetic field line 3 shown in FIGS. 1 and 2. The desired selective neutralization of ions works when there are proton spin dependent states that are preferentially formed, i.e., selective neutralization of $H^-$ ions will be the result of selective formation of $H^o$ atoms. Various possibilities could be explored in perfecting alternative arrangements of the method of the invention, for example, formation of $H^o$ atoms in the ground state, and formation of excited hydrogen atoms, in the $n=2$ level. A major advantage of operating near the threshold, i.e. with $H^o$ atoms in the ground state, is the more ready commercial availability of suitable lasers; however, for such atoms the photodetachment cross section is low. On the other hand, while the cross section for the formation of excited hydrogen atoms is 11 orders of magnitude higher, presently available commercial lasers that operate at that wavelength of 1135 Å have short pulses.

To further explain the preferred embodiment of the inventive process disclosed herein, the description of the process will now consider photodetachment of $H^-$ ions which result in ground state $H^o$ atoms, because more data exists for that case, including experimental clarification of it. As pointed out above, it will be seen that $D^-$ ions can also be as readily formed by practicing the invention as taught herein. There exists in the prior art extensive data about photodetachment of $H^-$ ions, but the effects of an external magnetic field on the photodetachment cross section has not been incorporated in that pre-existing data, as was done with respect to the photodetachment of $S^-$ in the presence of a magnetic field, per the explanation in the above referenced paper by Blumberg et al. Selective neutralization for achieving nuclear polarized beams has not been discussed anywhere, so far as the present inventor is aware.

The main difference realized between achieving photodetachment in the presence of a magnetic field, versus achieving such photodetachment in the absence of a magnetic field, is the resultant quantization of the energy of the free electrons formed in a magnetic field into the well known Landau levels. When photodetachment is effected in a magnetic field, the electron dipole magnetic moment $\mu$ and the external magnetic field B combined to produce an energy shift from each Landau level of $\mu$.B. Accordingly, in each such shifted level, there can be either an electron spin up from one Landau level, or an electron spin down from a higher Landau level.

Figure 3B:
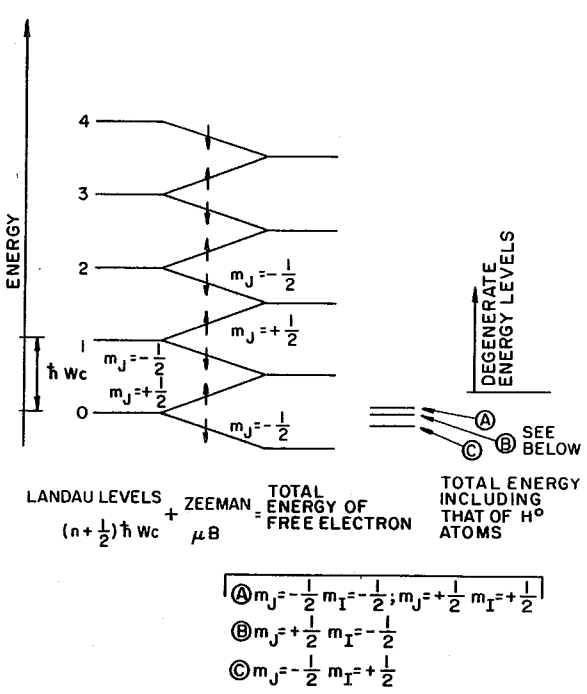
FIG. 3 is divided into sections 3*a* and 3*b*, both of which schematically illustrate energy levels of a stripped electron and an $H^o$ atom for magnetic fields below, as in FIG. 3*a*, or above, as in FIG. 3*b*, the critical field, as explained in the disclosed process of the invention.
Figure 3A:
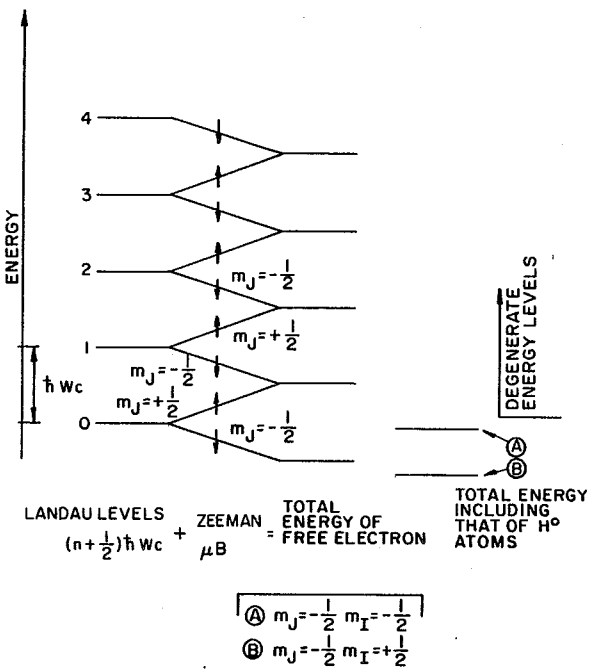

Because the lowest energy level in the ground state hydrogen atom $H^o$ is produced with electron spin down and proton spin up, the lowest energy state of the detached $H^-$ ion is an $H^o$ ion with electron spin down, proton spin up, and a free electron spin up. Referring to FIG. 3(*a,b*), it will be seen that there is shown combined energy levels of a stripped $H^-$ ion in a magnetic field of a few hundred Gauss. These illustrated combined energy levels show the added energy levels of the free electron and the $H^o$ atom in the ground state. The depicted Landau levels refer to the energy levels of a free electron in a magnetic field, with the levels being quantized perpendicular to the field. As the term "degenerate levels" is used in FIGS. 3*a* and 3*b*, it means that the depicted levels are either truly degenerate, or are very closely spaced. As shown by the equations in FIGS. 3*a* and 3*b*, energy levels of a stripped electron and an $H^o$ atom is the total energy of a free electron, which is shown to equal the sum of the Landau levels, the Zeeman energy and the energy of the $H^o$ atom. FIG. 3*a* shows those energy levels for magnetic fields below the critical field, whereas those energy levels are shown in FIG. 3*b* for magnetic fields above the critical field. As shown by FIGS. 3*a* and 3*b* and the foregoing discussion, there exists the possibility of selectively detaching a spin up electron from $H^-$ ions with a proton spin up. In terms of frequency units, the energy difference between hydrogen atoms with proton spin down and those with proton spin up (with the electron spin down), is over 400 MHz, for magnetic fields of a few hundred Gauss up to fields of about 1000 Gauss. Thus, it can be seen that from a qualitative standpoint a resolution of about 100 MHz is sufficient to achieve such selective detachment. Presently available commercial lasers have much better resolutions than 100 MHz.

Because the beam of laser light 4A that is used in the process of the invention, can be made arbitrarily narrow, the effective Doppler broadening of the laser beam, as seen by $H^-$ ions due to their thermal spread, becomes a limiting factor. In the absence of any acceleration, the Doppler width of a beam from a conventional $H^-$ ion source is much larger than any hyperfine separation or splitting attainable, e.g. at one electron volt the Doppler width is about $8.5\times10^9$ Hz. However, if the beam is accelerated a phenomenom known as kinematic compression occurs. In other words, there is a reduction in Doppler width due to Doppler shift, which can be easily compensated for by adjusting the laser frequency. The factor by which Doppler width is reduced, $R=\frac{1}{2}(kT/eU)^{\frac{1}{2}}$ where T is the beam temperature and U is the accelerating potential. Accordingly, the reduced Doppler width becomes $\Delta V=\Delta V\ (O)\ R$. In the case of a typical currently available $H^-$ ion source, such as that available from the accelerator now in operation at Brookhaven National Laboratory, Upton, N.Y., which produces $H^-$ ions having a thermal spread of about 4 eV, extracted at 20 kV, $\Delta V$ approximates 120 MHz. Such Doppler broadening is already acceptable for use in the process of the present invention, and it can readily be further reduced if desired. In practicing the preferred arrangement of the process of the invention, a Penning source whose thermal spread is about 1 eV is used. Thus, the selective neutralization effected in the process can be done by making the $H^-$ ion beam 1A from the negative ion source 1 shown in FIGS. 1 and 2 have energy of about 1 KeV.

To select a suitable laser, for the laser 4 used in practicing the preferred arrangement of the process of the invention, as shown in FIGS. 1 and 2 it should be understood that the photon flux i.e., P (photon/cm$^2$/second) can be estimated from the equation:

$$p \simeq \phi Pt \quad (1)$$

Where, $\phi$ is the photodetachment cross-section and t is the intersection time. At one KeV for an intersection region of about 4 meters, t approximates $10^{-5}$ second. At the threshold, the photodetachment cross section when extrapolated from experimental and theoretical results is seen to be only $10^{-24}$ cm$^2$. Solution of equation (1) yields P approximately $10^{29}$ photons/cm$^2$/sec. Assuming a beam cross section A approximating 0.1 cm$^2$, the required Power for 0.75 eV photons is:

$$\text{Power} = APh\nu = 10^{11} \text{ watts} \quad (2)$$

In the foreseeable future there seems little hope of achieving such a Power level. The purpose of showing this calculation is to indicate that the primary problem in this case of a single photon absorption stems from low cross section near threshold while it peaks at about 1.5 eV photons. By contrast, the double photon absorbtion cross section, which requires the use of a 3.2 micron laser, peaks at threshold. Since the $H^-$ ion has a very high degree of dynamic polarizability, the cross section for double photon absorption must be high at threshold.

An alternative approach is to use 10.93 eV photons (i.e. use a 1135 Å laser), whose photo detachment products are a free electron and an $H^o$ atom excited in the n=2 level. At this photon energy, the photodetachment cross section has a very sharp resonance whose magnitude is $1.4 \times 10^{-15}$ cm$^2$. Using this value of cross section in equation (1), above, and a hv of 10.93 eV in equation (2) the Power needed becomes:

$$\text{Power} = 12.5 \text{ watts} \quad (3)$$

Lyman Alpha lasers are available having Power levels of 100 watts in pulses of 10's of nanoseconds. Utilization of such a laser for the laser 4 shown in FIG. 2 is the preferred arrangement for practicing the process of the invention. In alternative arrangements of the process of the invention, a commercial 32000 Å laser can be used for the laser 4 shown in FIGS. 1 and 2, in a double photon absorption case having a large cross section, i.e. where the $H^o$ atom is left in the n=1 level. In a further alternative process, a 1135 Å laser could be used for the laser 4 shown in FIG. 2, with the resulting $H^o$ atom in the n=2 level. With presently available commerical lasers, the latter approach would limit use of the process to short pulses in the 10's of nanoseconds. If free electron lasers become available in the future, the limits of the process would be greatly expanded.

Figure 4:
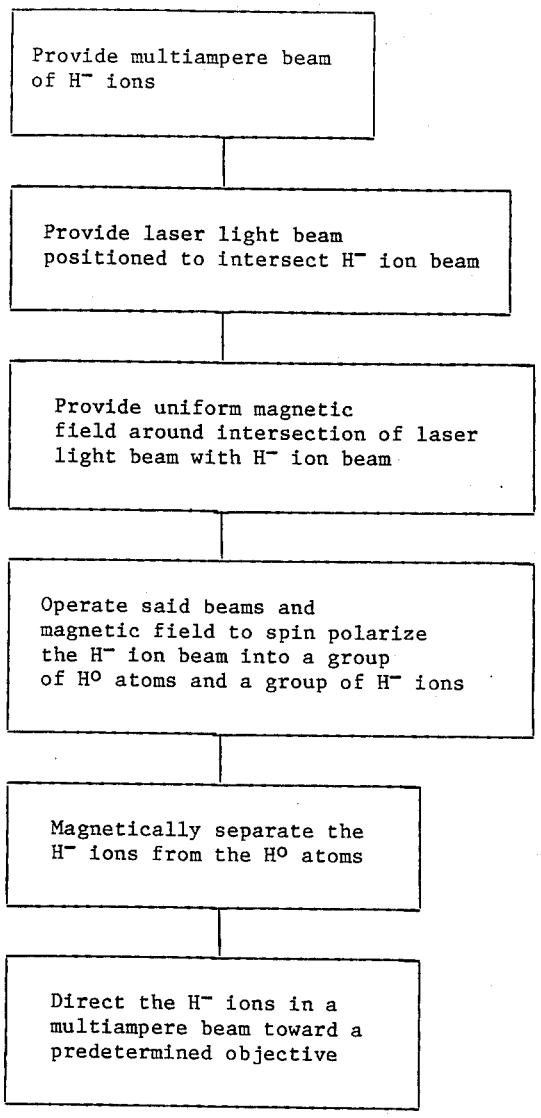
FIG. 4 is a flow chart illustrating the preferred steps of one arrangement of the process of the invention.

The operation of the preferred arrangements of the process of the invention, as illustrated for example in FIGS. 1 and 2, will now be briefly summarized to better explain the steps of the process. To achieve selective neutralization of $H^-$ ions in a magnetic field, thereby to produce an intense negative hydrogen ion beam with spin polarized protons, it will be understood from the foregoing description of the invention that a first step of the process, as it is illustrated in FIG. 4, is to provide a suitable multi-ampere beam 1A of $H^-$ ions from the negative ion source 1, which may comprise any suitable source, such as one of the available $H^-$ ion beam lines now in operation at Brookhaven National Laboratory. In the next step of the process a beam of laser light 4A is provided from a suitable laser 4. As explained above, such a suitable laser 4 is a 1135 Å laser whose photodetachment products are a free electron and an $H^o$ atom excited in the n=2 level, in the most preferred arrangement of the process of the invention.

In alternative arangements of the process, the beam of laser light 4A is produced by a 32,000 Å laser, or in still other alternatives of the process, the laser 4 that is used is in the range of 1135 Å to 32,000 Å. Furthermore, if the laser light beam 4A is polarized other advantageous selection rules apply; thus, for 1135 Å and 16,000 Å polarized laser light the process works well without requiring a finely tuned laser.

In the next step of the preferred process, a uniform solenoid magnetic field, as indicated by the magnetic field line 3 in FIGS. 1 and 2, is provided around a portion of the beam of $H^-$ ions 1A, to effectively spin polarize the $H^-$ ions in that beam and thereby to produce a first group of ions having their proton spin aligned with the magnetic field designated by magnetic field line 3, and to produce a second group of ions with their proton spin opposite to the magnetic field. Then, the beam of laser light 4A is directed through the spin polarized $H^-$ ions, either co-axially therewith as shown in FIG. 1, or transverse thereto as shown in FIG. 2, in order to selectively neutralize a majority of the ions in one of the above mentioned groups of ions, without neutralizing the ions in the other group. Finally, one of the groups of ions is separated from the other group of ions and then directed in an intense $H^-$ ion beam toward a predetermined objective, such as the accelerator 7 shown in FIGS. 1 and 2. Of course, the ion beam may be further directed by the accelerator 7 to a desired end use.

In the most preferred process of the invention, as mentioned above, the arrangement of components shown in FIG. 2 is utilized, and the magnetic field designated by the magnetic field line 3 is below $10^8$ Gauss. Most preferably, that magnetic field is at least 200 Gauss and is sufficiently strong to result in Zeeman hyperfine splitting of the $H^-$ ion beam into two energy states that are solely dependent on the polarization of the respective nuclei of the $H^-$ ion beam. Also, in the most preferred arrangement of the process of the invention, the selected negative ion source 1 is operable to produce an intense beam of $H^-$ ions 1A that is a multi-ampere beam. In such an arrangement of the process of the invention, the first group of $H^-$ ions is preferably neutralized, while the second group of $H^-$ ions is separated from that first group of ions and formed into an intense beam of $H^-$ ions that is then directed into the accelerator 7. In that operation of the invention, the second group of ions is separated from the first group of ions by curving the longitudinal axis of the magnetic field line 3, as shown by the bend 3A therein, in order to bend the intense beam of $H^-$ ions in a path that diverts the second group of ions away from the neutralized ions, which are shown by the symbol $H^o$ and the associated arrow in FIG. 2, so that the $H^-$ ions, as shown by the symbols adjacent the accelerator 7 in FIG. 2, are directed into that accelerator.

From the foregoing description it will be recognized that further alternatives and modifications of the invention may be practiced without departing from its true scope. Accordingly, it is my intention to include all such alternatives and modifications within the limits and spirit of the following claims.

I claim:

1. A process for selective neutralization of $H^-$ ions in a magnetic field to produce an intense negative hydrogen ion beam with spin polarized protons, comprising the steps of:

providing a multi-ampere beam of $H^-$ ions;

providing a beam of laser light, any photon of which has sufficient energy to photodetach one electron from any one of the $H^-$ ions;

providing a uniform solenoidal magnetic field around a portion of the length of said beam of $H^-$ ions to effectively spin polarize the $H^-$ ions in said beam, thereby to produce a first group of ions with proton spin aligned with said magnetic field and to produce a second group of ions with proton spin opposed to said magnetic field;

directing said beam of laser light through the spin polarized beam of $H^-$ ions to selectively neutralize the majority of the ions in one of said groups, without neutralizing the ions in the other group;

separating said one group of ions from said other group of ions, and directing said other group of ions in an intense $H^-$ ion beam toward a predetermined objective.

2. A process as defined in claim 1 wherein said beam of laser light is produced by a 1135 Å laser whose photodetachment products are a free electron and an $H^o$ atom excited in the $n=2$ level.

3. A process as defined in claim 1 wherein said beam of laser light is produced by a 32,000 Å laser.

4. A process as defined in claim 1 wherein said beam of laser light is produced by a laser operating in the range 1135 Å to 32,000 Å.

5. A process as defined in claim 4 wherein said magnetic field is below $10^8$ Gauss and said beam of laser light is produced by either a 1135 Å laser or by a 16,000 Å laser.

6. A process as defined in claim 5 wherein said beam of laser light is positioned transverse to, and in intersecting relationship with, said spin polarized beam of $H^-$ ions.

7. A process as defined in claim 5 wherein said beam of laser light is positioned substantially co-linearly with said spin polarized beam of $H^-$ ions.

8. A process as defined in claim 6 wherein the first group of ions is neutralized, and wherein the second group of ions is separated from the first group of ions and formed into an intense beam of $H^-$ ions.

9. A process as defined in claim 8 wherein said second group of ions is separated from the first group of ions by curving the longitudinal axis of said magnetic field, thereby to bend said intense beam of $H^-$ ions in a path that diverts said second group of ions away from the neutralized ions in the first group.

10. A process as defined in claim 8 wherein said intense beam of $H^-$ ions is a multi-ampere beam.

11. A process as defined in claim 5 wherein said magnetic field is at least 100 Gauss and is sufficiently strong to result in Zeeman hyperfine splitting of the $H^-$ ion beam into two populations or groups of ions whose neutralization energy is solely dependent, respectively, on the selective polarization of their respective nuclei in said $H^-$ ion beam.

* * * * *